US009185944B2

(12) United States Patent
Zhen

(10) Patent No.: US 9,185,944 B2
(45) Date of Patent: Nov. 17, 2015

(54) STRUCTURE AND METHOD FOR APPAREL AND ACCESSORIES

(75) Inventor: Mao Zhen, Shanghai (CN)

(73) Assignee: SHANGHAI FAN TAI ZHI MAO LTD., Shanghai (CN)

( * ) Notice: Subject to any disclaimer, the term of this patent is extended or adjusted under 35 U.S.C. 154(b) by 678 days.

(21) Appl. No.: 12/535,393

(22) Filed: Aug. 4, 2009

(65) Prior Publication Data

US 2011/0030124 A1 Feb. 10, 2011

(51) Int. Cl.
*A42B 1/24* (2006.01)

(52) U.S. Cl.
CPC ..... *A42B 1/24* (2013.01)

(58) Field of Classification Search
CPC ..... A42B 1/006; A42B 1/24
USPC ..... 2/209.11, 209.12, 209.13, 175.1, 195.1; 63/1.11, 1.12, 1.13, 1.18, 900; 473/406
See application file for complete search history.

(56) References Cited

U.S. PATENT DOCUMENTS

| | | | | |
|---|---|---|---|---|
| 4,130,950 | A * | 12/1978 | Bazzle et al. | 36/127 |
| 4,982,449 | A * | 1/1991 | Finkelstein | 2/200.1 |
| 5,429,393 | A * | 7/1995 | Parlo | 283/75 |
| 5,996,116 | A | 12/1999 | Tate | |
| 6,163,889 | A * | 12/2000 | Tate | 2/209.13 |
| 6,170,088 | B1 * | 1/2001 | Tate | 2/209.13 |
| 6,966,851 | B1 * | 11/2005 | England et al. | 473/406 |
| 7,073,206 | B2 * | 7/2006 | Yan | 2/171 |
| 7,640,601 | B2 * | 1/2010 | Lee | 2/209.13 |
| 2002/0034992 | A1 * | 3/2002 | Tate | 473/406 |
| 2003/0166423 | A1 * | 9/2003 | Rao | 473/406 |
| 2004/0117894 | A1 * | 6/2004 | Kuo | 2/209.13 |
| 2007/0028361 | A1 * | 2/2007 | Ashy | 2/209.13 |
| 2009/0265837 | A1 * | 10/2009 | Cunliffe | 2/244 |
| 2010/0325780 | A1 * | 12/2010 | Scanlan | 2/209.13 |
| 2011/0078843 | A1 * | 4/2011 | Kennedy | 2/209.13 |

FOREIGN PATENT DOCUMENTS

| | | | |
|---|---|---|---|
| CN | 2205126 | Y | 8/1995 |
| CN | 2582406 | Y | 10/2003 |
| CN | 200959861 | Y | 10/2007 |
| EP | 1000563 | A1 | 5/2000 |
| EP | 1099458 | A2 | 5/2001 |

OTHER PUBLICATIONS

International Search Report of PCT/IB2010/001877—Date of Completion of Search: Nov. 4, 2010, 5 pages.

* cited by examiner

*Primary Examiner* — Nathan Durham
*Assistant Examiner* — Sally Haden
(74) *Attorney, Agent, or Firm* — Locke Lord LLP

(57) ABSTRACT

Structures and methods applicable, for example, to apparel and accessories. Such a structure might, for instance, include a layer imparting rigidity. A layer might, for example, be situated above the layer imparting rigidity. Alternately or additionally a layer might, for instance, be situated below the layer imparting rigidity. Situated within one or more discontinuities might, for example, be one or more magnets. One or more platforms might, for instance, be situated above such a layer situated above the layer imparting rigidity. Alternately or additionally one or more platforms might, for example, be situated below such a layer situated below the layer imparting rigidity. One or more items placed on one or more of the platforms might, for instance, be attracted to one or more of the magnets.

10 Claims, 10 Drawing Sheets

STRUCTURE AND METHOD FOR APPAREL AND ACCESSORIES

FIELD OF INVENTION

This invention relates to structures and methods for apparel and accessories.

BACKGROUND INFORMATION

In recent times, there has been an increase in individuals adopting apparel and accessories. For example, many individuals are increasingly adopting apparel and accessories perceived to be aesthetically pleasing. As another example, many individuals are increasingly adopting apparel and accessories perceived to provide useful functionality. As yet another example, many individuals are increasingly adopting apparel and accessories associated with sports (e.g., golf). Accordingly, there may be interest in provision of further apparel and accessories integrating various aesthetic and functional aspects.

SUMMARY OF THE INVENTION

According to embodiments of the present invention, there are provided structures and methods applicable, for example, to apparel and accessories integrating various aesthetic and functional aspects.

Such a structure might, in various embodiments, include a layer imparting rigidity. A layer might, in various embodiments, be situated above the layer imparting rigidity. Alternately or additionally a layer might, in various embodiments, be situated below the layer imparting rigidity. Situated within one or more discontinuities might, in various embodiments, be one or more magnets.

One or more platforms might, in various embodiments, be situated above such a layer situated above the layer imparting rigidity. Alternately or additionally one or more platforms might, in various embodiments, be situated below such a layer situated below the layer imparting rigidity. One or more items placed on one or more of the platforms might, in various embodiments, be attracted to one or more of the magnets.

DETAILED DESCRIPTION OF THE INVENTION

General Aspects

According to embodiments of the present invention, there are provided structures and methods applicable, for example, to apparel and accessories integrating various aesthetic and functional aspects.

Such a structure might, in various embodiments, include a layer imparting rigidity. A layer might, in various embodiments, be situated above the layer imparting rigidity. Alternately or additionally a layer might, in various embodiments, be situated below the layer imparting rigidity. Such a layer situated above and/or such a layer situated below might, in various embodiments, include one or more discontinuities. Situated within the discontinuities might, in various embodiments, be one or more magnets.

One or more platforms might, in various embodiments, be situated above such a layer situated above the layer imparting rigidity. Alternately or additionally one or more platforms might, in various embodiments, be situated below such a layer situated below the layer imparting rigidity. One or more items (e.g., golf ball markers) placed on one or more of the platforms might, in various embodiments, be attracted to one or more of the magnets. One or more of such platforms might, in various embodiments, include one or more logos.

The structure might, in various embodiments, be a visor, a flap, a strap, and/or a board. The structure might, in various embodiments, be employed in apparel and/or accessories (e.g., golf and/or other sport apparel and/or accessories).

Various aspects of the present invention will now be discussed in greater detail.

Composition

Figure 1A:
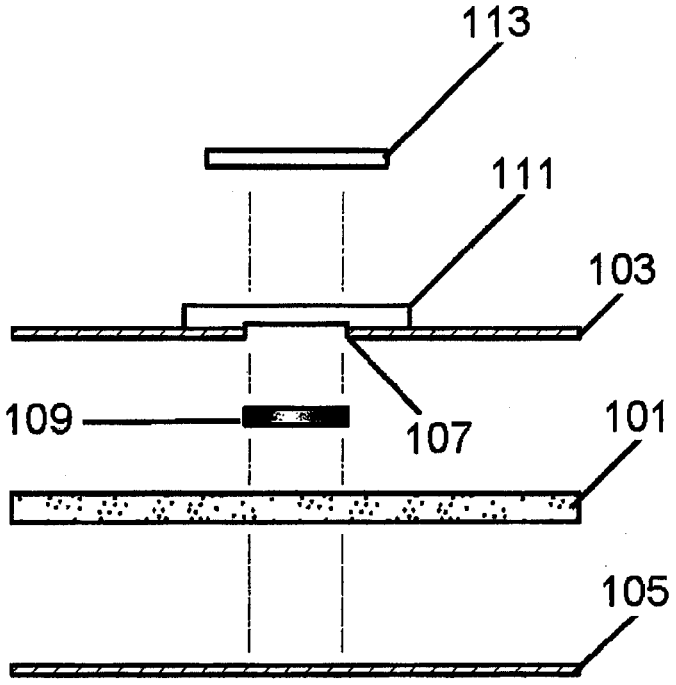
FIG. 1A shows an exemplary disassembled structure side-view depiction according to various embodiments of the present invention.

With respect to FIG. 1A it is noted that a structure might, for example, include a first layer (layer 101) imparting rigidity to the structure. Layer 101 might, for instance, be composed of cardboard and/or plastic. Formulation of layer 101 might, for example, involve cutting and/or molding.

The structure might, for example, include a layer 103 situated above layer 101. Alternately or additionally the structure might, for instance, include a layer 105 situated below layer 101. Layer 103 and/or layer 105 might, for example, be composed of flexible material. Such flexible material might, for instance, include fabric, rubber, paper, and/or plastic. Layer 103 and/or layer 105 might, for example, be affixed to one another and/or to layer 101 via stitching, glue, screws, and/or rivets. Formulation of layer 103 and/or layer 105 might, for instance, involve cutting and/or molding.

Layer 103 and/or layer 105 might, for example, include one or more discontinuities. For instance, layer 103 might, as depicted in FIG. 1A, include a discontinuity 107. Formulation of such discontinuities might, for example, involve stitching, welding (e.g., sonic welding), drilling, molding, melting, and/or etching. The constitution of such a discontinuity might, for instance, be such that it is, with respect to the layer in which it is included, open at both ends (e.g., such a discontinuity might be a hole in the layer in which it is included. The constitution of such a discontinuity might, for instance, be such that it is, with respect to the layer in which it is included, closed at one end (e.g., such a discontinuity might represent a depression, such as a depression having a down-facing opening, in the layer in which it is included).

One or more magnets might, for example, be situated in such discontinuities. For instance, with reference to FIG. 1A it is noted that discontinuity 107 might include a magnet 109. The magnets might, for example, float freely in the discontinuities and/or be affixed in the discontinuities (e.g., via adhesive).

The structure might, for example, include one or more platforms situated above layer 103 and/or one or more platforms situated below layer 105. For instance, as depicted in FIG. 1A situated above layer 103 might be a platform 111. Attracted to one or more of the magnets might, for example, be one or more items (e.g., ferromagnetic and/or partially ferromagnetic items) placed on one or more of the platforms. For instance, turning again to FIG. 1A an item 113 placed on platform 111 might be attracted to magnet 107. Such items might, for example, be golf ball markers, repair tools (e.g., divot repair tools), can openers, eyewear items (e.g., golf and/or other sport eyewear items), and/or writing utensils (e.g., golf and/or other sport writing utensils). Presence of such a platform might, for instance, serve to ease removal of an attracted item.

It is noted that the structure might, for instance, be employed without any such items being placed (e.g., without any items being placed on platform 111). For example, in the case where the structure is, as is further discussed below, employed in headwear, such headwear might be worn without placement of any such items (e.g., without placement of a golf ball marker).

Such a circumstance might, for example, arise in the case where a wearer misplaced such an item (e.g., where the wearer misplaced a golf ball marker). Such circumstance might, as another example, arise in the case where a wearer opted, for reasons unrelated to item loss, to so wear without item placement (e.g., where the wearer misplaced no golf ball marker, but was motivated for fashion or other reasons to wear without item placement).

It is further noted that substitution of such items might, for instance, occur. Such substitution might, for example, occur in the case where such an item was misplaced (e.g., by such a wearer). For instance, a wearer misplacing such a golf ball marker might substitute another item for the golf ball marker (e.g., the wearer might substitute a coin and/or other ferromagnetic and/or partially ferromagnetic item for the golf ball marker).

One or more of the platforms might, for instance, be composed of material different than those employed in other portions of the structure. For example, turning to FIG. 1A platform 111 might be composed of material different than material composing layer 101, material composing layer 103, and/or material composing layer 105. A platform might, for instance, be composed of silicone, rubber, paper, and/or plastic. Formulation of a platform might, for example, involve cutting and/or molding. A platform might, for instance, be circular, semicircular, ovoid, or polygonal in shape.

One or more of the magnets might, for instance, differ in size from one or more of the platforms. Accordingly, for example, depicted in FIG. 1A is magnet 107 being smaller than platform 111. Such size difference might, for instance, ease removal of an attracted item.

Moreover, one or more of the platforms might, for example, differ in size from one or more items (e.g., items of the sort discussed above). Accordingly, for instance, depicted in FIG. 1A is platform 103 being larger than item 113. Such size difference might, for instance, ease removal of an attracted item.

One or more of the platforms might, for example, include one or more logos. For example, turning to FIG. 1A platform 111 might include one or more logos. Such logos might, for instance, include insignia, letters, and/or images. Formulation of such logos might, for example, involve welding (e.g., sonic welding), drilling, molding, melting, and/or etching.

One or more of the platforms might, for instance, include one or more discontinuities. Accordingly, for example, a platform might include a single discontinuity. Such platform discontinuities might, for instance, be formulated in a manner analogous to that discussed above. For example, welding (e.g., sonic welding), drilling, molding, melting, and/or etching might be employed. The constitution of such a platform discontinuity might, for example, be such that it is, with respect to the platform in which it is included, open at both ends (e.g., such a discontinuity might be a hole in the platform in which it is included). The constitution of a such a platform discontinuity might, for example, be such that it is, with respect to the platform in which it is included, closed at one end (e.g., such a discontinuity might represent a depression, such as a depression having a down-facing opening, in the platform in which it is included). The one or more platforms might, for instance, be affixed via stitching, glue, screws, and/or rivets.

Figure 1B:
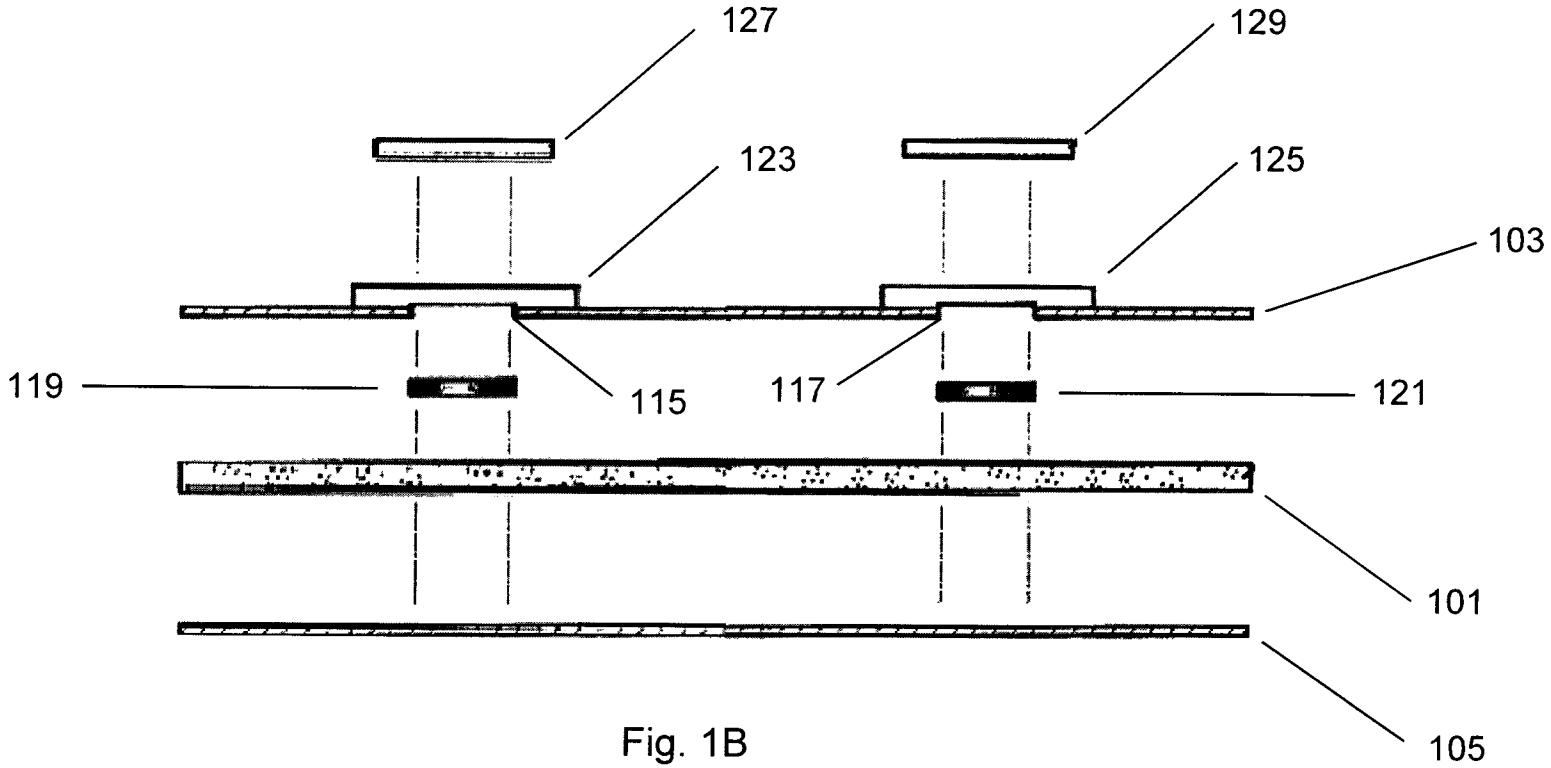
FIG. 1B shows a further exemplary disassembled structure side-view depiction according to various embodiments of the present invention.

With respect to FIG. 1B it is noted that layer 103 and/or layer 105 might, for example, include a plurality of discontinuities. For instance, layer 103 might, as depicted in FIG. 1B, include discontinuity 115 and discontinuity 117. With additional reference to FIG. 1B, a plurality of magnets might be situated in such discontinuities. For example, discontinuity 115 might include a magnet 119 and discontinuity 117 might include a magnet 121. With further respect to FIG. 1B, a plurality of platforms might, for example, be situated above layer 103 and/or a plurality of platforms might be situated below layer 105. For instance, as depicted in FIG. 1B situated above layer 103 might be platform 123 and platform 125. With still further reference to FIG. 1B, attracted to the plurality of magnets might, for example, be a plurality of items. For instance, turning again to FIG. 1B an item 127 placed on platform 123 might be attracted to magnet 119 and an item 129 placed on platform 125 might be attracted to magnet 121.

Figure 2:
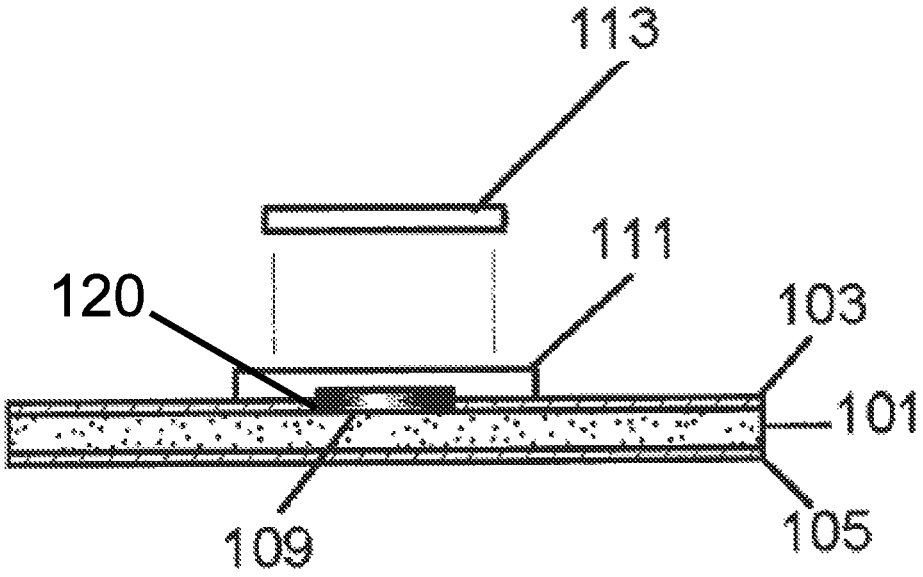
FIG. 2 shows an exemplary assembled structure side-view depiction according to various embodiments of the present invention.
Figure 3:
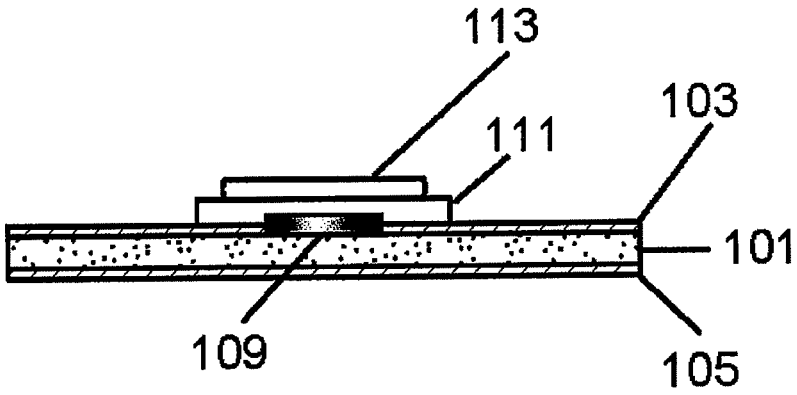
FIG. 3 shows a further exemplary assembled structure side-view depiction according to various embodiments of the present invention.

FIG. 1A might, for instance, be considered an exemplary side-view depiction corresponding to the structure in a disassembled state. FIG. 1B might, for instance, be considered a further exemplary side-view depiction corresponding to the structure in a disassembled state. FIG. 2 might, for instance, be considered an exemplary side-view depiction corresponding to the structure in an assembled state wherein item 113 is detached. FIG. 3 might, for instance, be considered an exemplary side-view depiction corresponding to the structure in an assembled state wherein item 113 is attached.

Figure 4:
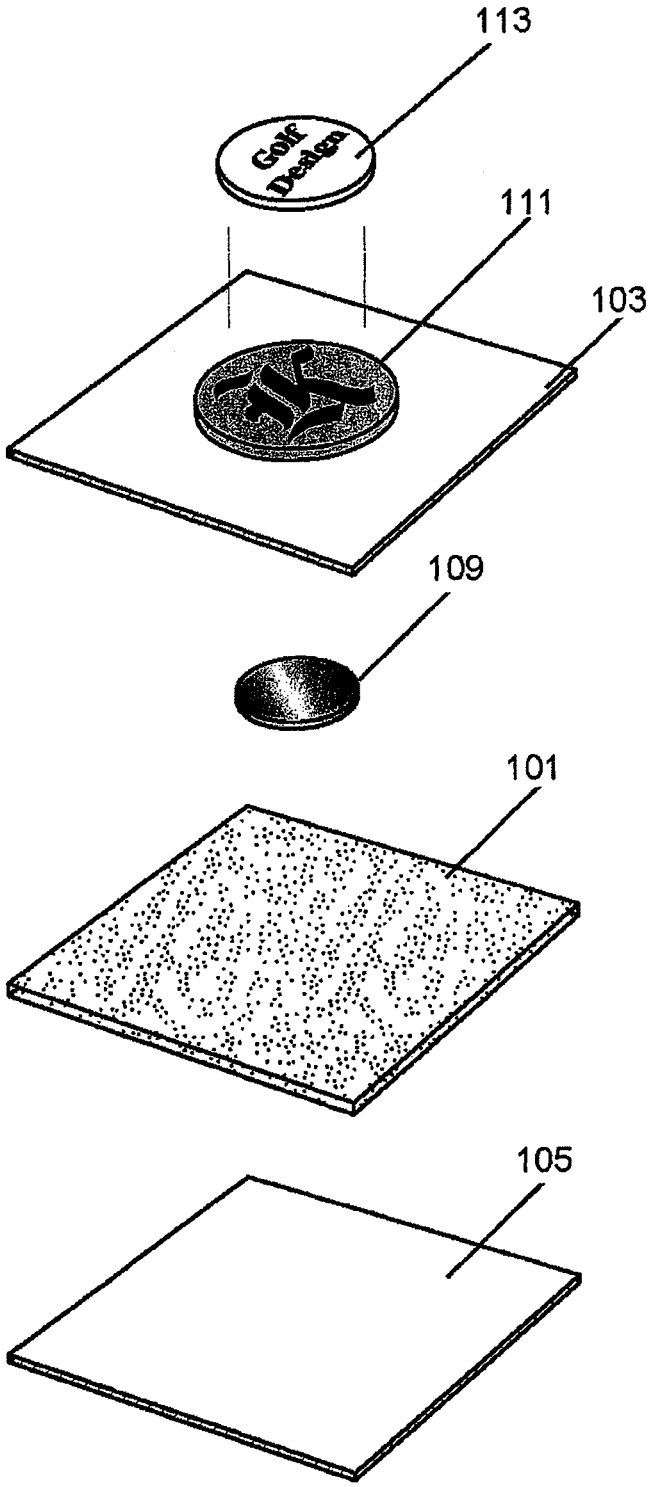
FIG. 4 shows an exemplary disassembled structure top-view depiction according to various embodiments of the present invention.
Figure 5:
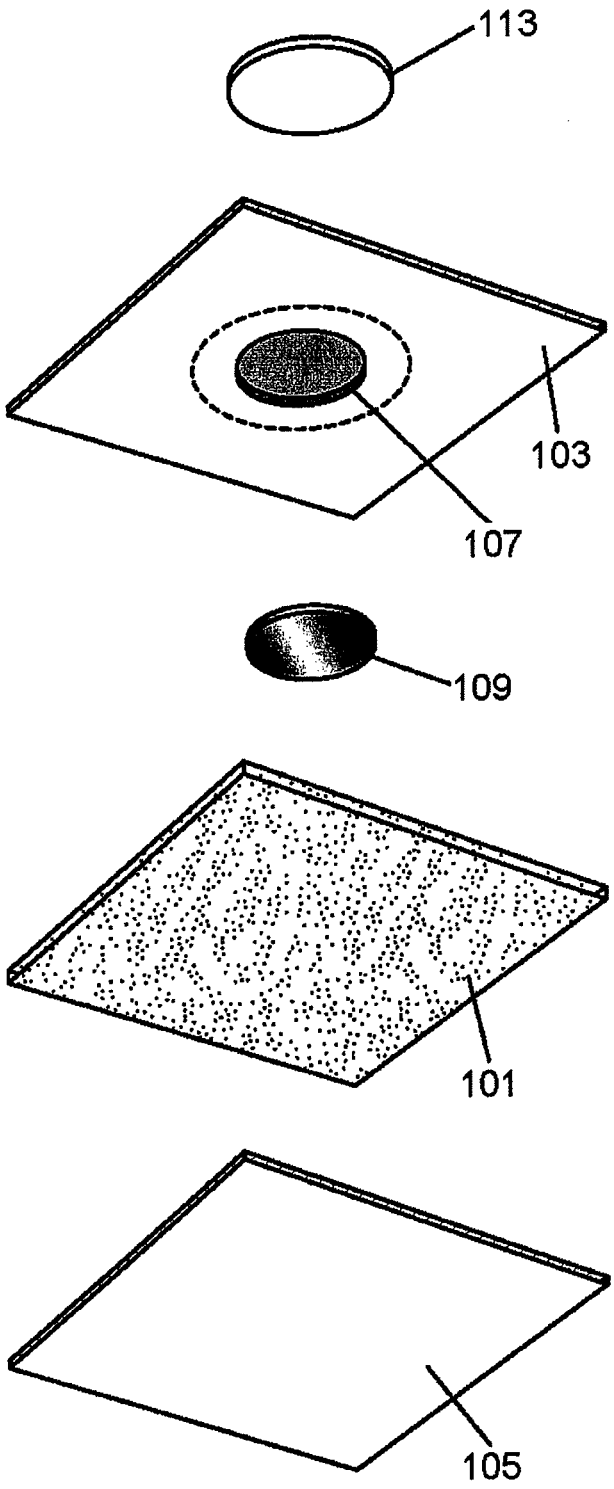
FIG. 5 shows an exemplary disassembled structure bottom-view depiction according to various embodiments of the present invention.

FIG. 4 might, for instance, be considered an exemplary top-view depiction corresponding to the structure in a disassembled state. FIG. 5 might, for instance, be considered an exemplary bottom-view depiction corresponding to the structure in a disassembled state.

The structure might, for example, be a visor, a flap, a strap, and/or a board. Such a structure might, for instance, be employed in apparel and/or accessories. Such apparel and/or accessories might, for example, include headwear (e.g., golf and/or other sport headwear), bags (e.g., golf and/or other sport bags), and/or clipboards (e.g., handheld golf and/or other sport clipboards or clipboards mounted in golf and/or other sport carts or other vehicles). Such employment of the of the structure might, for example, involve affixment via stitching, glue, screws, and/or rivets. For instance, the structure, formulated as a visor, might be stitched to headwear (e.g., to the dome, band 605, and/or crown of the headwear).

Such headwear might, for example, include a visor and a dome (e.g., the visor might be attached to the dome). As another example, such headwear might lack a dome but include a visor and a band (e.g., the visor might be attached to the band). As an additional example, such headwear might include a visor and a crushed crown (e.g., the visor might be attached to the crushed crown).

Shapes for various elements discussed above might, for instance, be chosen in accordance with the structure application. For example, in the case where the structure application is that of a visor, layer 101, layer 103, and/or layer 105 might have a shape matching the shape of the visor.

Figure 6:
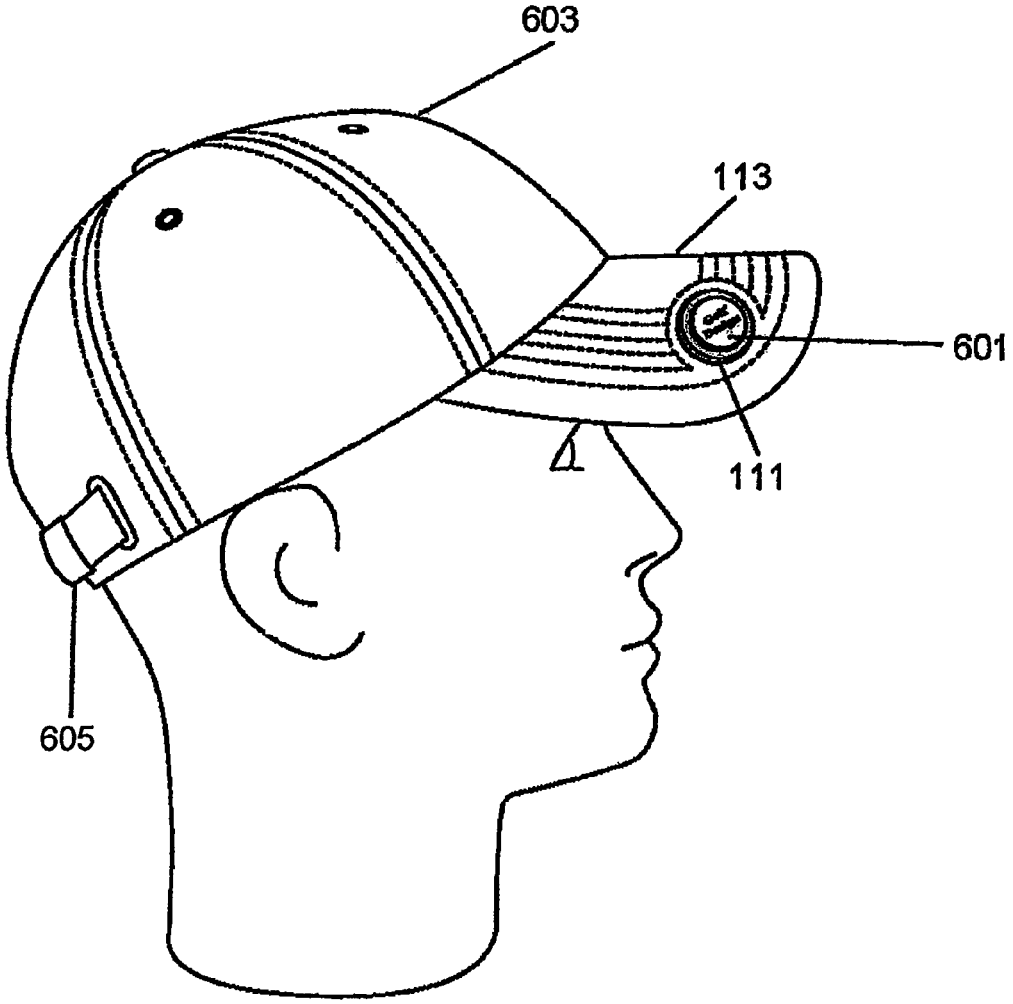
FIG. 6 shows an exemplary headwear side-view depiction according to various embodiments of the present invention.
Figure 7:
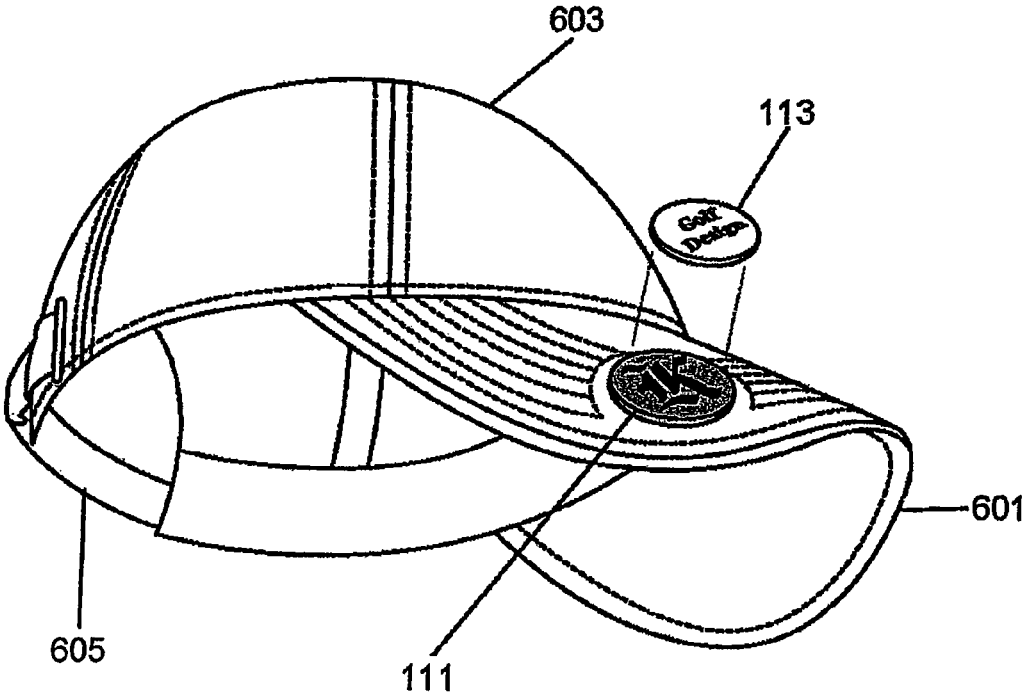
FIG. 7 shows an exemplary headwear bottom-view depiction according to various embodiments of the present invention.

FIG. 6 might, for instance, be considered an exemplary side-view depiction corresponding to headwear (e.g., of the sort discussed above). Included, for example, in FIG. 6 are a visor 601 (e.g., of the sort discussed above) and a dome 603 (e.g., of the sort discussed above). FIG. 7 might, for instance, be considered an exemplary bottom-view depiction corresponding to headwear (e.g., of the sort discussed above).

Figure 8:
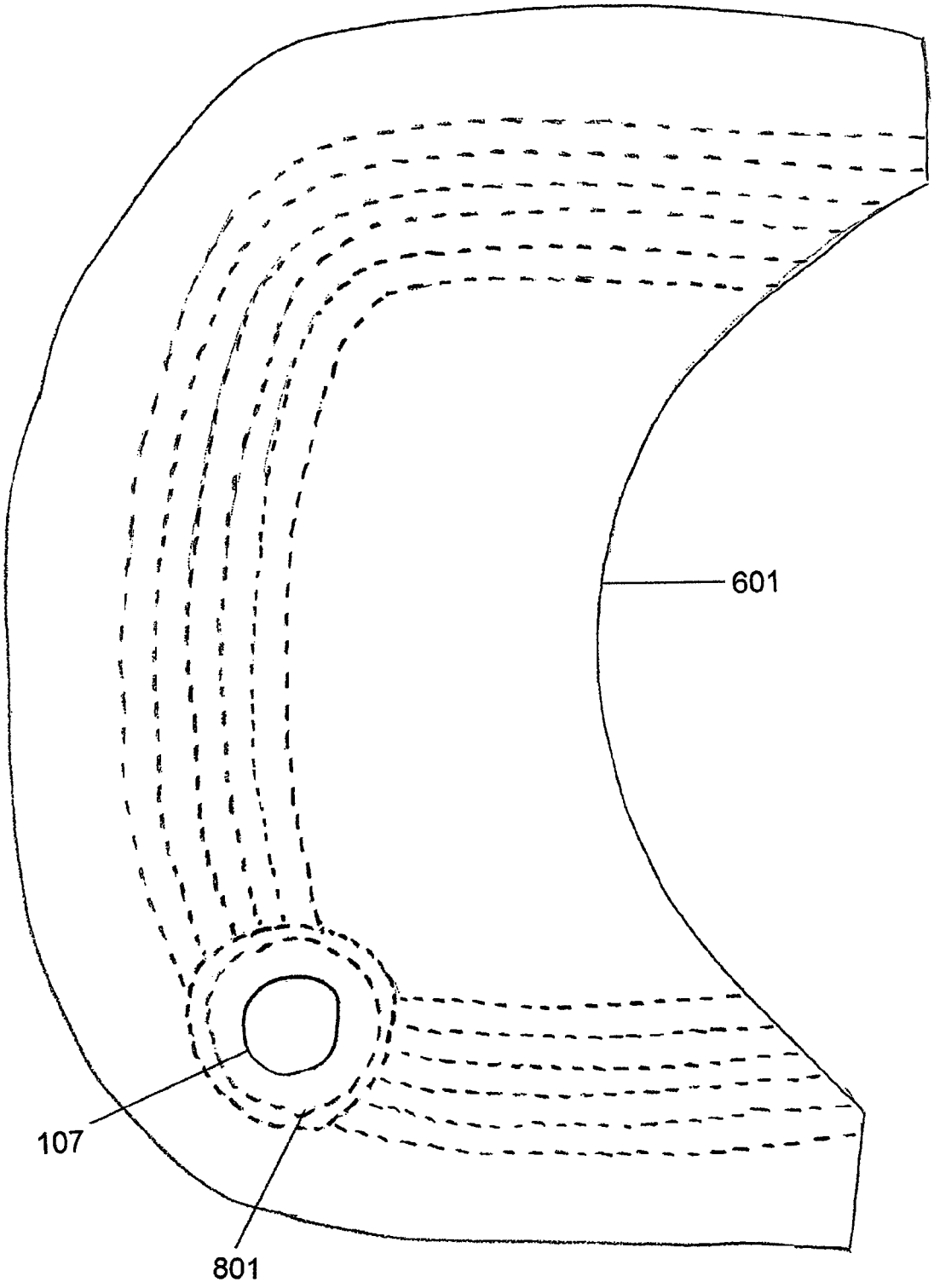
FIG. 8 shows an exemplary visor bottom-view depiction according to various embodiments of the present invention.

FIG. 8 might, for instance, be considered an exemplary bottom-view visor depiction including, for example, discontinuity-formulating stitching 801 (e.g., of the sort discussed above) which forms a discontinuity 107 such as a depression 120 as shown in FIG. 2.

Assembly

Figure 9:
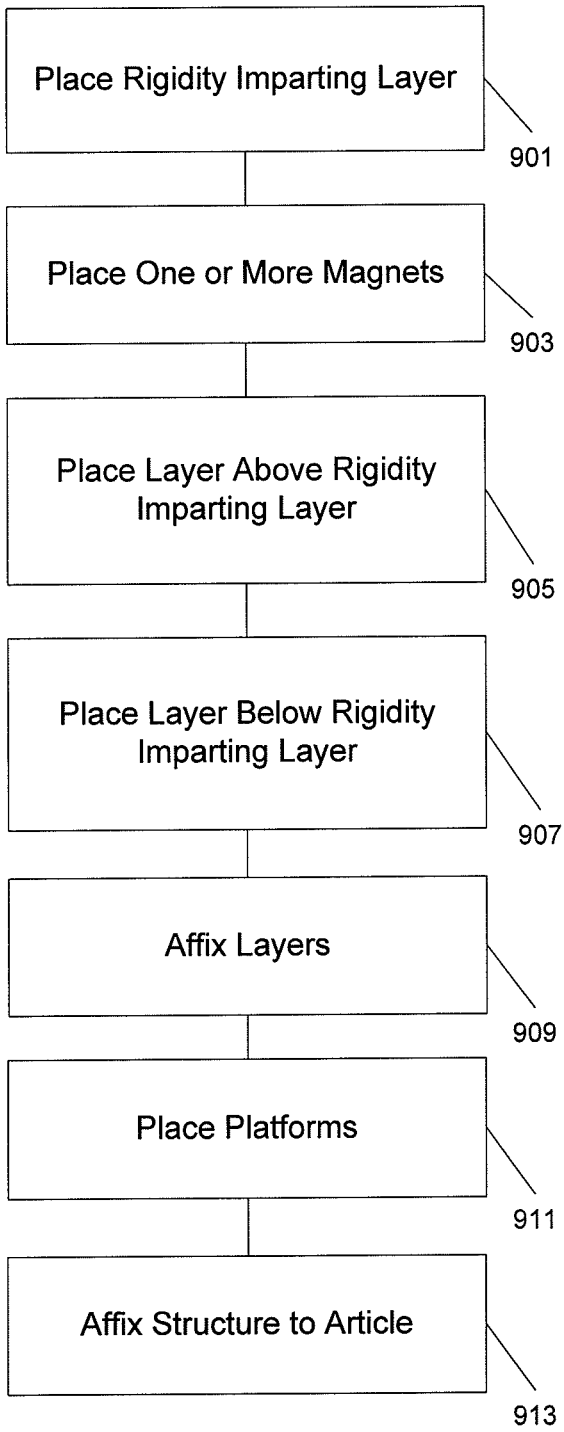
FIG. 9 shows exemplary steps involved in assembly according to various embodiments of the present invention.

With respect to FIG. 9 it is noted that rigidity-imparting layer 101 of the structure might, for example, be placed (step 901). One or more magnets 109 might, for example, be placed (e.g., in the manner discussed above) in one or more discontinuities 107 of layer 103 and/or layer 105 (step 903).

Layer 103 of the structure might, for instance, be placed above rigidity-imparting layer 101 (step 905). Layer 105 of the structure might, for example, be placed below rigidity-imparting layer 101 (step 907). It is noted that layer 103 or layer 105 might, for instance, be omitted from a particular structure. Layer 103 and/or layer 105 might, for example, be affixed to one another and/or to layer 101 (e.g., in the manner discussed above) (step 909).

One or more platforms 111 of the structure might, for instance, be placed above layer 103, and/or one or more platforms 111 might be placed below layer 105 (step 911). Such placement might, for example, involve affixment of the sort discussed above.

The structure might, for instance, be affixed to an article (step 913). For example, as noted above the structure, formulated as a visor, might be stitched to headwear.

RAMIFICATIONS AND SCOPE

Although the description above contains many specifics, these are merely provided to illustrate the invention and should not be construed as limitations of the invention's scope. Thus it will be apparent to those skilled in the art that various modifications and variations can be made in the structures and methods of the present invention without departing from the spirit or scope of the invention.

In addition, the embodiments, features, structures, methods, and details of the invention that are described above in the application may be combined separately or in any combination to create or describe new embodiments of the invention.

What is claimed is:

1. A visor device, comprising:

a visor comprised of at least a first layer and a second layer, wherein said first layer imparts rigidity to the visor; wherein said second layer is one of fabric, rubber, paper, or plastic;

wherein said second layer includes one or more non-magnet-piercing stitch-formulated magnet receiver depressions, wherein stitching circumscribes said depressions, and wherein said stitch-formulated magnet receiver depressions provide for magnet free floating;

one or more platforms wherein at least one of said platforms is formed of material differing from material forming said second layer, and wherein said platforms include one or more platform discontinuities; and one or more magnets, wherein each of said one or more magnets is situated within one of said one or more stitch-formulated magnet receiver depressions and within one of said one or more platform discontinuities, wherein said visor device is configured such that it is capable of magnetically attracting and retaining an item if such item is placed on one or more of said platforms, wherein the second layer is situated between the first layer and the one or more platforms, wherein the first layer is more rigid than the second layer, and wherein each of said one or more magnets substantially fills up one of said one or more stitch-formulated magnet receiver depressions and a respective one of said one or more platform discontinuities.

2. The visor device of claim 1, further comprising a magnetically attractive item to place on said one or more platforms, the magnetically attractive item being used in the playing of a sport.

3. The visor device of claim 2, wherein at least one of said platforms differs in size from said item used in the playing of a sport.

4. The visor device of claim 1, further comprising a third layer, wherein the first layer is situated between the second layer and the third layer, and wherein the first layer is more rigid than the third layer.

5. The visor device of claim 1, wherein at least one of said magnets is smaller than a corresponding one of said platforms.

6. The visor device of claim 1, wherein at least one of said platforms includes one or more logos.

7. The visor device of claim 6, wherein at least one of said logos is a sonic welded logo.

8. The visor device of claim 1, wherein at least one of said platforms is formed from silicone.

9. The visor device of claim 1, wherein said visor is employed in headwear.

10. Headwear, comprising:

a visor device comprising a visor including at least a first layer and a second layer, wherein said first layer imparts rigidity to the visor; wherein said second layer is one of fabric, rubber, paper, or plastic;

wherein said second layer includes one or more non-magnet-piercing stitch-formulated magnet receiver depressions, wherein stitching circumscribes said depressions, and wherein said stitch-formulated magnet receiver depressions provide for magnet free floating;

one or more platforms wherein at least one of said platforms is formed of material differing from material forming said second layer, and wherein said platforms include one or more platform discontinuities; and one or more magnets, wherein each of said one or more magnets is situated within one of said one or more stitch-formulated magnet receiver depressions and within one of said one or more platform discontinuities, wherein said visor device is configured such that it is capable of magnetically attracting and retaining a golf item if such item is placed on one or more of said platforms, wherein the second layer is situated between the first layer and the one or more platforms, wherein the first layer is more rigid than the second layer, wherein at least one of said platforms differs in size from a golf item, and wherein one of the one or more magnets substantially fills up one of said one or more stitch-formulated magnet receiver depressions and a respective one of said one or more platform discontinuities; and one of a band and a dome.

* * * * *